United States Patent [19]

Houle et al.

[11] Patent Number: 4,972,066

[45] Date of Patent: Nov. 20, 1990

[54] METHOD AND APPARATUS FOR REDUCING THE CURRENT DRAIN ON THE SACRIFICIAL ANODE IN A WATER HEATER

[75] Inventors: Timothy H. Houle, Wauwatosa; Daher T. Wardy, Milwaukee, both of Wis.

[73] Assignee: A.O. Smith Corporation, Milwaukee, Wis.

[21] Appl. No.: 403,705

[22] Filed: Sep. 6, 1989

[51] Int. Cl.[5] ..... F24H 1/00

[52] U.S. Cl. ..... 392/457; 204/196; 204/197

[58] Field of Search ..... 219/322, 363, 481, 331, 219/318, 321, 327; 204/196, 197

[56] References Cited

U.S. PATENT DOCUMENTS

| | | | |
|---|---|---|---|
| 3,132,082 | 5/1964 | Overmyer | 219/322 |
| 3,176,115 | 5/1963 | Balis | 219/322 |
| 3,425,921 | 2/1969 | Sudrabin | 204/196 |
| 4,255,242 | 3/1981 | Freeman | 204/196 |
| 4,255,647 | 3/1981 | Rickert et al. | 219/322 |
| 4,848,616 | 7/1989 | Nozaki . | |

*Primary Examiner*—Bruce A. Reynolds
*Assistant Examiner*—Tu Hoang
*Attorney, Agent, or Firm*—Andrus, Sceales, Starke & Sawall

[57] ABSTRACT

The adverse effects of the exposed metal jacket on a heating element in an electric water heater on the life and performance of a protective anode are eliminated or substantially reduced with the system that imposes a low voltage differential between the heating element jacket and the tank wall while simultaneously providing a low resistance current path which will provide a direct coductive path between the jacket and tank wall (at ground) in the event of an overvoltage condition. The system includes a potentiometer control which may be adjusted to provide the appropriate low voltage differential sufficient to substantially reduce the anode current. The relatively low resistance path allows an overvoltage current to pass readily to ground.

10 Claims, 1 Drawing Sheet

METHOD AND APPARATUS FOR REDUCING THE CURRENT DRAIN ON THE SACRIFICIAL ANODE IN A WATER HEATER

BACKGROUND OF THE INVENTION

The present invention relates to a method and apparatus for reducing the rate of loss of a sacrificial protective anode in a water storage tank as a result of undesirable cathodic reactions and, more particularly, to a method and apparatus for reducing the protective anode current and dissolution of the anode as a result of the cathodic effect of the metal-jacketed heating element in an electric water heater.

A typical water heater includes a storage tank made of ferrous metal and lined internally with a glass-like porcelain enamel to protect the metal from corrosion. Nevertheless, the protective lining may have imperfections or, of necessity, not entirely cover the ferrous metal interior, such that an electrolytic corrosion cell may be established as a result of dissolved solids in the stored water leading to corrosion of the exposed ferrous metal and substantial reduced service life of the water heater. The water in the tank may be heated by gas or electric power and it is well known that uninhibited corrosion is substantially enhanced in the presence of hot water.

It is also well known in the art to utilize a sacrificial anode within the tank to protect against corrosion of the ferrous metal tank interior. The sacrificial anode is selected from a material which is electronegative with respect to the tank and by galvanic reaction maintains the tank metal in a passive and non-corrosive state. Alternatively, a protective anode may be powered by providing a source of electrical potential to establish a positive voltage differential between the anode and the tank.

In an electric water heater, an electric heating element is attached to the tank wall and extends into the tank to provide direct heating of the water. The heating element typically includes an internal high resistance heating element wire surrounded by a suitable insulating material and enclosed in a metal jacket such that the jacket is completely insulated from the internal heating element. Power for the heating element is typically supplied from a conventional 110 or 220 volt AC source. When the exterior metal jacket of the heating element is immersed in the water in the tank, it imposes an electrical load on the protective anode in the same manner as the exposed ferrous metal interior of the tank. As a result, the protective anode current is increased and the anode is subject to more rapid dissolution. Therefore, the life of the anode and thus the water heater are substantially shortened. In a typical electric water heater, less than half the protective anode current is needed to protect the tank interior with the remaining current resulting from the additional load imposed by the heating element jacket. However, the heating element jacket typically comprises or is plated with a metal more electropositive than the tank metal and thus does not require the same level of cathodic protection. In addition, heating elements are relatively inexpensive and easy to replace. In addition to the large current draw imposed on the protective anode by the heating element jacket, the heating element also creates a "shadowing" effect on any exposed interior portions of the tank in the vicinity of the heating element. As a result, anode current which might otherwise protect these areas of the tank flows instead to the heating element jacket and leaves the metal tank wall portions in this area with inadequate protection.

It would be most desirable, therefore, to reduce the electrical load which the heating element jacket imposes on the protective anode in an electric hot water heater. One way would be to simply electrically insulate the heating element jacket from the tank. However, the metal tank is typically grounded and, for safety reasons, a conductive path must be provided between the heating element jacket and the tank to provide a shunt for an overvoltage condition, such as would occur if damage to the heating element resulted in a short between the interior element wire and the metal jacket. Another solution to the problem would be to provide a resistance connection between the heating element jacket and the tank wall to reduce the anode current. However, to effectively reduce the anode current draw, the resistance would be too great to provide an adequate ground path in the event of an overload condition. It would also be possible to establish an impressed voltage differential between the heating element jacket and the tank wall, with the former maintained positive with respect to the latter. However, with the heating element jacket otherwise electrically insulated from the tank to allow maintenance of the potential difference, a conductive path for an overvoltage condition would not be available.

Thus, there remains a need for a practical solution to the excessive current draw and shadowing effect which an electric heating element jacket causes in an anodically protected electric water heater.

SUMMARY OF THE INVENTION

In accordance with the present invention, the increase in protective anode current and the shadowing effect created by the metal jacket of an electric heating element in a water heater are eliminated or substantially reduced with a system that imposes a low voltage differential between the heating element jacket and the tank and includes a relatively low resistance current path which will provide a direct conductive path between the jacket and the tank wall in the event of an overvoltage condition, such as a short circuit between the internal high voltage heating element wire and the heating element jacket.

The method and apparatus of the present invention require that the normally direct conductive connection provided by mounting the heating element directly to the tank wall be eliminated and an electrically insulating separation be inserted therebetween. An external source of direct current potential is provided and an appropriate circuit is utilized to apply a potential from the source between the jacket and the tank such that the jacket is maintained positive with respect to the tank. The circuit also provides an overvoltage current path between the jacket and the tank wall. The overvoltage current path preferably comprises a resistance connection between the jacket and the tank wall. The circuit also preferably includes a potentiometric control with a variable resistance operable to simultaneously vary the applied potential between the jacket and the tank and the resistance of the overvoltage current path between the jacket and tank.

The method of the present invention broadly comprises the steps of insulating the heating element jacket from the tank wall, imposing a low voltage differential between the jacket and the tank maintaining the former positive with respect to the latter, and providing a separate relatively low resistance path between the jacket and the tank which is conducting under high overvoltage conditions.

DETAILED DESCRIPTION OF THE PREFERRED EMBODIMENT

Figure 1:
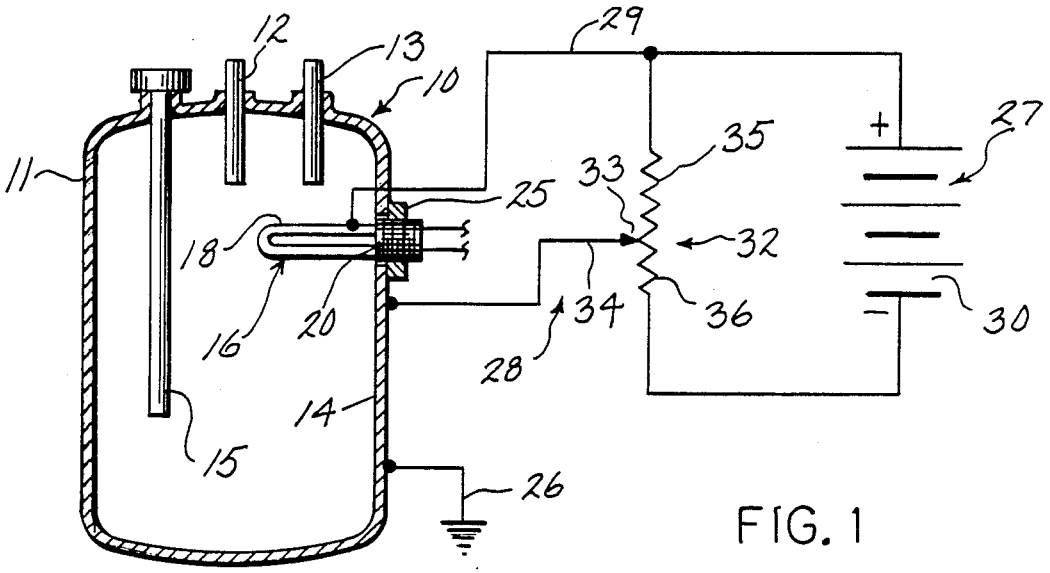
FIG. 1 is a schematic representation of an electrically heated water heater in which the tank is provided with a protective anode and the heating element is provided with the protective circuit of the present invention.
Figure 2:
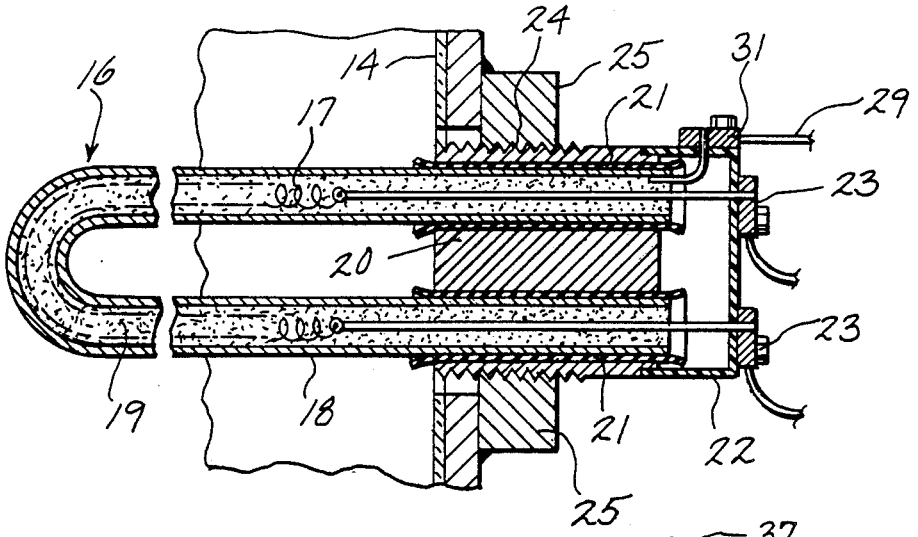
FIG. 2 is an enlarged detail of a section through the tank wall of a water heater showing the heating element and tank connected to the protective bias circuit of the present invention.

Referring first to FIGS. 1 and 2, an electric water heater 10 includes a tank 11 made of a ferrous metal, i.e. steel, in which water is stored and heated. The tank includes a cold water inlet 12 and heated water outlet 13, both of a conventional construction. To provide corrosion protection to the interior of the tank, a glass or ceramic lining 14 covers substantially the entire interior of the tank. However, as is well known in the art, minute cracks or other imperfections may develop in the lining 14 or certain portions of the metal tank may not be covered by the lining 14, such that the metal is exposed to the water in the tank. As a result of the usual dissolved minerals and other solids in the water, electrolytic corrosion of the exposed tank will occur absent appropriate protection.

A protective anode 15 is mounted on and extends into the interior of the tank 11 to provide corrosion protection in a known manner. The anode 15 may be of a passive type, as shown, wherein it is constructed of a metal more electronegative than the tank metal to establish an electrochemical couple with the anode 15 acting as a sacrificial electrode to protect the interior tank wall. Alternately, the anode 15 could be externally powered to provide a positive potential difference between the anode and the tank wall without regard to the type of metal from which the anode is constructed. In either case, oxidative dissolution of the anode over time protects the exposed interior metal portions of the tank.

In the electric water heater 10, an electric heating element 16 is mounted in the wall of the tank 11 and extends into the tank interior to contact and heat the water stored therein. In accordance with conventional construction, the heating element 16 includes a high resistance element wire 17 disposed within a U-shaped metal jacket 18 and insulated therefrom by an interior layer of a granular refractory material 19, such as magnesium oxide. The opposite ends of the heating element wire 17 are typically attached to a source of alternating current at 220 or 10 volts. The heating element jacket 18 is typically made of copper and may additionally be tin or zinc plated.

The outer end of the heating element 16 includes a mounting plug 20 for supporting the heating element jacket and attaching the heating element to the tank wall 11. The legs of the heating element jacket extend through the mounting plug 20 and are electrically insulated from the conductive metal plug 0 by insulating sleeves 21. The ends of the heating element wire 17 also extend through the mounting plug to an insulating terminal mount 22 on the outside thereof for connection to a pair of terminals 23 from the AC power source. The mounting plug 20 is provided with exterior threads 24 for attachment to an internally threaded spud or mounting ring 25 which is welded or otherwise attached directly to the tank wall 11. It should be pointed out that, in conventional construction, the insulating sleeves 21 between the heating element jacket 18 and the mounting plug 20 are eliminated, such that there is a direct conductive connection between the jacket and the tank wall. In addition, the tank wall is typically grounded, as at 26. Should damage to or a defect in the heating element result in the wire 17 coming in direct contact with the jacket 18, the prior art construction allows the high voltage current imposed on the heating element jacket to be shunted directly to ground via the conductive connection to the tank wall.

The exposed metal jacket 18 which extends into the water in the tank 11 provides a substantial bare metal surface area which, if conductively connected to the tank, induces a substantially higher current in the protective anode 15 resulting in more rapid dissolution thereof. As previously indicated, merely insulating the element jacket 18 from the tank wall, as with the insulating sleeves 21, would substantially reduce or eliminate the current drain by the heating element on the anode. However, the conductive path between the heating element and ground in the event of an overvoltage condition would be lost. In the preferred embodiment of the present invention, a source of controlled DC potential 27 is operatively attached to the heating element jacket and the tank wall via protective circuit 28 to simultaneously provide both an imposed positive potential on the heating element jacket 18 and an overvoltage current path between the jacket and the tank wall. The combined effect is to eliminate or substantially limit the unnecessary current drain by the heating element on the sacrificial anode 15 and protect against the potential electrical hazard resulting from a short circuit between the heating element wire 17 and the jacket 18. In particular, the DC power supply 27 may comprise a conventional 6 volt battery 30, the positive terminal of which is connected directly to the heating element jacket 18 via positive lead 29 and a jacket terminal 31 on the exterior terminal mount 22. The remainder of the circuit 28 comprises a potentiometer 32 including a variable resistance element 33 having a variable contact 34 connected directly to the tank wall 11. The first fixed leg 35 of the variable resistance 33 is connected to the positive lead between the battery terminal and the element jacket. The second fixed leg 36 of the variable resistor is connected to the negative terminal lead of the battery 30. The battery 30 causes a voltage potential to be impressed between the heating element jacket and the tank wall through the water in the tank. The heating element jacket is maintained positive as a result of its direct connection to the positive terminal of the battery 30 and the value of the potential difference will depend upon the position of the variable contact 34 and the conductivity of the water in the tank.

In the circuit 28 shown in the drawing, a 6 volt battery 30 having a nominal six amp-hour rating is connected as shown to the potentiometer 32 having a variable resistance ranging from 0 to 50 ohms. The variable contact 34 is adjusted until the current flow between anode 15 and tank wall 11 is reduced by approximately one-half. As indicated previously, the impressed potential difference between the heating element jacket and the tank wall will vary depending upon the conductivity of the water varying with the temperature thereof, and other environmental factors. For example, a balanced condition as described above and a potential difference of 0.1 to 0.7 volts results from varying the resistance in the leg 35 in the range of between six ohms and 32 ohms. The indicated potential difference is adequate to effectively eliminate the excessive current drain by the heating element jacket on the anode 15. However, should an overvoltage condition occur in the heating element jacket, a relatively low resistance current path to ground 26 is provided via the first leg 35 of the variable resistance, the variable contact 34 and the tank wall 11.

Figure 3:
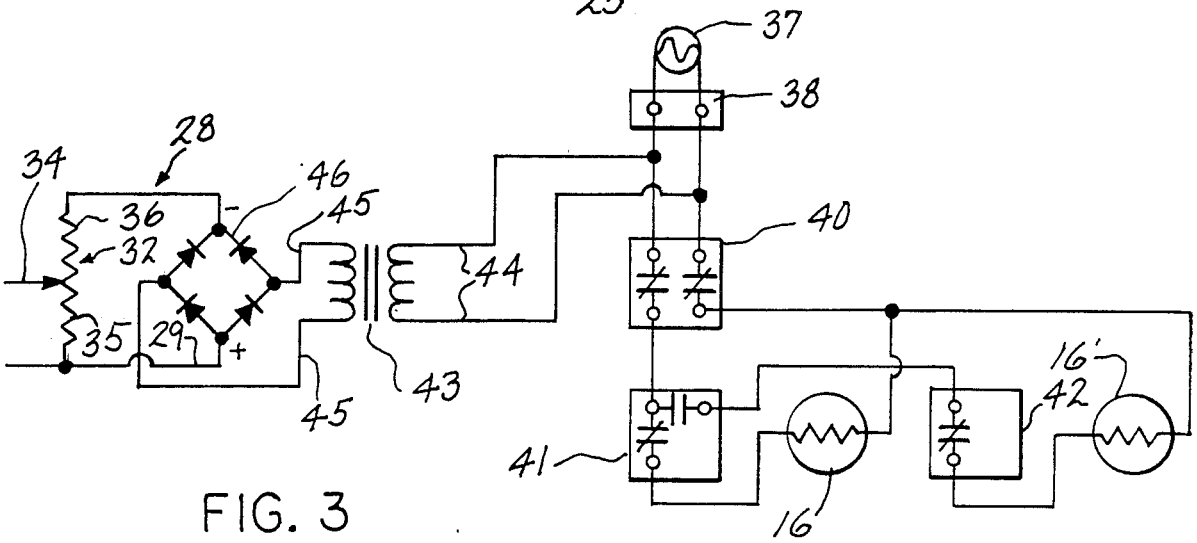
FIG. 3 is a schematic of an alternate embodiment of the protective circuit of the present invention utilizing the power source for the heating element to provide the power for the protective circuit.

Referring also to FIG. 3, the DC power source for the protective circuit 28 may be provided by the AC power source for the heating element (or elements 16 and 16' in the case of a two element system as shown). A conventional two wire circuit for non-simultaneous operation of the heating elements 16 and 16' includes connection to an AC power source 37 via a conventional junction box 38 and a protective high limit switch 40. Direct control of heating element 16 is provided by a double throw thermostat 41 and, similarly, control of heating element 16' is effected by single throw thermostat 42, all in a conventional manner well known in the art. A transformer 43 is connected by suitable primary leads 44 to the AC power source. Secondary leads 45 from the step down transformer 43 are connected via a conventional four diode bridge 46 to provide a rectified DC current to the circuit 28 which is identical to that shown in FIGS. 1 and 2.

Various modes of carrying out the present invention are contemplated as being within the scope of the following claims particularly pointing out and distinctly claiming the subject matter which is regarded as the invention.

We claim:

1. In an electically-heated water supply including a metal tank for heating and storing water, a protective anode within the tank to reduce electrolytic corrosion of exposed interior portions of the tank wall, and an electric heating element enclosed in a metal jacket mounted in the tank wall and extending into the tank, an apparatus for reducing the anode current as a result of the cathodic effect of the heating element jacket comprising:

an electrically insulating separation between the mounting of the metal jacket in the tank wall;

a source of controlled direct current potential; and, circuit means for applying a potential from the source between the jacket and the tank such that the jacket is maintained sufficiently positive with respect to the tank to substantially reduce the anode current and for providing an overvoltage current path between the jacket and the tank wall.

2. The apparatus as set forth in claim 1 wherein said overvoltage current path comprises an electrically resistive connection between the jacket and the tank wall.

3. The apparatus as set forth in claim 1 wherein said circuit means comprises a potentiometric control including a variable resistance operable to vary the potential between the jacket and the tank and to vary the resistance of the resistive connection.

4. The apparatus as set forth in claim 3 wherein the tank is maintained at ground potential.

5. The apparatus as set forth in claim 3 wherein the resistance of said resistive connection varies in the range of about 6–32 ohms.

6. The apparatus as set forth in claim 1 including a mounting plug supporting the heating element jacket and having means for attachment to the tank wall.

7. The apparatus as set forth in claim 6 wherein said insulating separation comprises sleeve means surrounding said jacket for insulating the same from the mounting plug.

8. The apparatus as set forth in claim 7 wherein said metal jacket is U-shaped and defines a pair of legs supported by the mounting plug and wherein said sleeve means comprises a sleeve for each leg.

9. The apparatus as set forth in claim 1 including an alternating current power source for the heating element and wherein the source of direct current potential comprises means for rectifying current from the power source.

10. In a metal tank for heating and storing water, including a protective anode within the tank to prevent electrolytic corrosion of exposed interior portions of the tank wall, and an electric heating element enclosed in a metal jacket and disposed within the tank, a method for reducing the anode current and dissolution of the anode as a result of the cathodic effect of the heating element jacket comprising the steps of:

insulating the heating element jacket from the tank wall;

imposing a low voltage differential between the jacket and the tank with the jacket maintained positive with respect to the tank; and, providing a relatively low resistance current path between the jacket and the tank wall which path is conducting at a high overvoltage condition.

* * * * *